United States Patent [19]

Vogt

[11] 4,410,101

[45] Oct. 18, 1983

[54] EASY OPENING TOP CLOSURE MEMBER ASSEMBLY FOR A CONTAINER

[76] Inventor: Kuno J. Vogt, 4250 ½ Fairmont Ave., San Diego, Calif. 92105

[21] Appl. No.: 224,004

[22] Filed: Jan. 12, 1981

[51] Int. Cl.[3] ..... B65D 51/20

[52] U.S. Cl. ..... 220/257; 220/260; 220/271; 220/269; 220/345

[58] Field of Search ..... 220/260, 269, 271, 359, 220/336, 270, 256, 257, 345

[56] References Cited

U.S. PATENT DOCUMENTS

| | | | |
|---|---|---|---|
| 4,135,637 | 1/1979 | Hannula | 220/271 |
| 4,162,742 | 7/1979 | Vogt | 220/269 |
| 4,215,791 | 8/1980 | Brochman | 220/271 X |

*Primary Examiner*—George T. Hall

*Attorney, Agent, or Firm*—Charles C. Logan, II

[57] ABSTRACT

An easy opening top closure member assembly for a container having a top member with an aperture of a predetermined configuration. A flexible foil strip member completely covers the top of the aperture. A disc member completely covers the bottom of the aperture. A pressure sensitive adhesive secured to the underside of the strip member holds the strip member securely to the top member and also to the portion of the disc member which covers the bottom of the aperture. The strip member has an open-loop scored portion which is positioned in direct contact with the top surface of the disc member. The open-loop scored portion has an interior hinge portion and two exterior hinge portions are functionally activated on the strip member when the strip is lifted at its one end to open the easy opening top closure member assembly.

9 Claims, 8 Drawing Figures

EASY OPENING TOP CLOSURE MEMBER ASSEMBLY FOR A CONTAINER

BACKGROUND OF THE INVENTION

The invention relates in general to container structure and more specifically to an easy opening top closure member for a container.

The popularity of the conventional pop-top beverage container has caused the problem of littering resulting from improper disposal of the tear-tab that is detached from the open container. These removable tear tabs which typically have sharp or rough metal edges, are frequently dropped on the ground as soon as the can is opened, thereby creating an unsightly and hazardous situation. Public criticism and dissatisfaction with the conventional pop-top beverage can, with its removable tear tab, has increased to the point where a number of jurisdictions have outlawed such beverage containers or are contemplating doing so.

A preferred solution to the problems created by the conventional pop-top would be an easy opening container which is manually operable by children as well as adults, which provide an effective pouring opening once opened which presents no psychological barriers to opening or beverage consumption, which is readily producable, and which is economically feasible. While many designs of easy-opening containers have been proposed as substitutions for the pop-top, none is known which effectively meets all the foregoing criteria to the satisfaction of the container manufacturer, the beverage packager, and the consumer of canned beverages.

One of the attempts to solve the littering problem is illustrated in U.S. Pat. No. 3,902,626. In the structure illustrated therein, the top of the container has had weakening indentations formed in the exterior surface to provide a fracturable web at the root of the indentation adapted to be fractured by inwardly directed pressure digitally applied against an integral outwardly projecting deflectable portion of a container component around the opening panel. This structure still has the drawback that the opening panel is pushed through the opening in the lid into the contents of the container thereby providing a danger of the opening panel being swallowed. Additionally as the opening panel is pushed through the top of the container there remains the risk of cutting or severing the finger tip as it is pushing the open panel through the aperture formed in the top of the container.

Other attempts have been made to design non-detachable easy open flap and tab assemblys such as are illustrated in U.S. Pat. Nos. 3,938,693 and 4,039,100. The major problem with the structures illustrated in these patents is their costliness of manufacture. Both of these structures eliminate the littering problem and also the danger of cutting the finger which is used to open the top.

It is an object of the invention to provide a novel easy opening top closure member for a container that may be non-detachable from the container.

It is also an object of the invention to provide a novel easy opening top closure member for a container that eliminates the danger of cutting one's finger when the top closure member is opened.

It is also an object of the invention to provide a novel easy opening top closure member for a container that will not be deposited within the container in such a manner as to provide a danger that the person drinking from the container may swallow the top closure member.

It is a further object of the invention to provide a novel easy opening top closure member for a container that is inexpensive to manufacture.

SUMMARY OF THE INVENTION

The novel easy opening top closure member assembly is utilizable with substantially any type of container, but is primarily designed for the carbonated beverage container. The container top member is formed with a cutout portion defining an aperture of a predetermined configuration. A flexible metal foil strip member having a width and length greater than that of the aperture completely covers the top of the aperture when it is positioned in its closed position. A disc member having a width and length greater than that of the aperture completely covers the bottom of the aperture when it is positioned in its closed position. The strip member has a pressure sensitive adhesive layer formed on its under side that secures the strip member to both the top surface of the top member and also the top surface of the disc member which is located beneath the aperture.

The strip member has an open-loop scored portion whose width and length are smaller than that of the aperture. This open-loop scored portion has an an interior hinge portion and two exterior hinge portions are functionally activated on the strip member when the strip member is lifted at its one end to open the easy-opening top closure member assembly.

In the operation of opening the top closure member assembly, a downward pushing force is applied on the top surface of the strip member over the concave dimple formed in the top surface of the top member. This causes the corners of the flexible metal foil strip member to raise slightly thereby making them easily graspable. As an upward force is applied to the tail portion of the strip member, a pressure vent aperture will be uncovered to aid in the operation of opening the top closure member assembly. This pressure vent aperture becomes more important where a pressurized beverage has been packaged in a container. When continued upward motion is applied to the strip member, the open-loop scored portion of the strip member will stay attached to the sealing disc member. The flexible foil strip member may now be pulled in a lateral direction along its longitudinal length to uncover the aperture. By tapping down the flexible foil strip member it will be caused to adhere to the top member, thereby holding the aperture open for pouring or drinking.

DESCRIPTION OF THE PREFERRED EMBODIMENT

Figure 1:
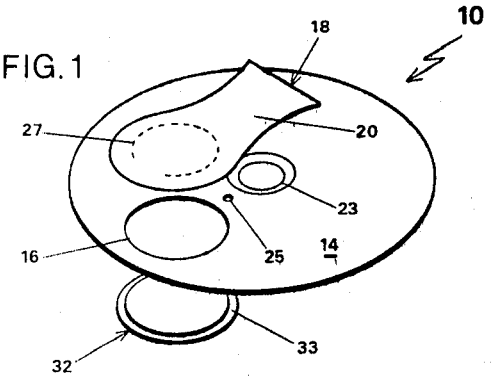
FIG. 1 is an exploded view of the novel easy opening top closure member assembly.

The novel easy opening top closure member assembly for a container is generally designated numeral 10. The container has a side wall 12 and a top member 14.

Top member 14 has a cut out portion defining an aperture 16 of a predetermined configuration. A flexible foil strip member 18 has a width and length greater than that of aperture 16 and completely covers the top of the aperture when it is positioned in its closed position.

Strip member 18 has a layer of pressure sensitive adhesive 19 attached to its underside. Strip member 18 has a tail portion 20 with a fold over portion 21 at its one end. Fold over portion 21 is located above a concave dimple 23 formed in the top surface of top member 14. Also lying beneath strip member 18 is a pressure vent aperture 25. An open-loop scored portion 27 is formed on strip member 18 and it has a diameter and width that is less than the corresponding dimensions of aperture 16. Strip member 18 also has interior hinge portion 28 and exterior hinge portions 29 and 30 that come into operation when strip member 18 is lifted upwardly from the top surface of member 14.

Figure 8:
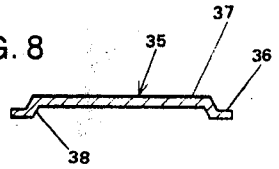
FIG. 8 is a cross sectional elevational view of an alternative configuration for the disc member.
Figure 2:
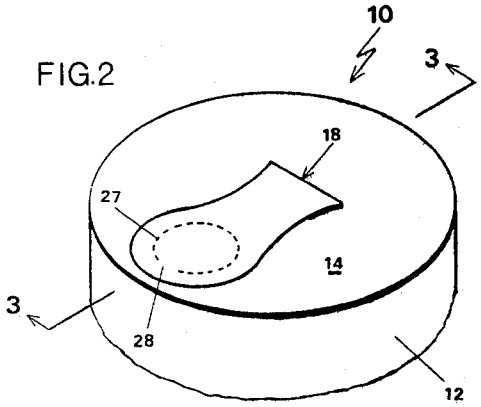
FIG. 2 is a perspective view of the novel easy opening top closure member assembly.
Figure 3:
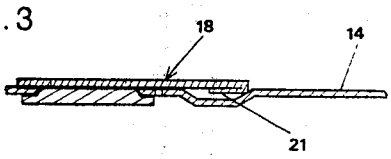
FIG. 3 is a cross sectional view taken along lines 3—3 of FIG. 2.
Figure 4:
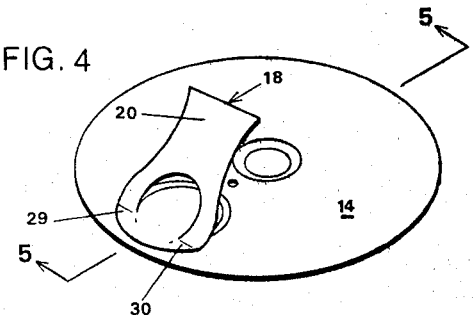
FIG. 4 is a perspective view of the novel easy opening top closure member illustrating the flexible foil strip member in its pulled upward position.
Figure 5:
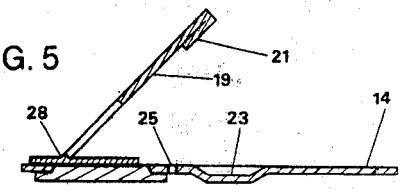
FIG. 5 is a cross sectional view taken along lines 5—5 of FIG. 4.
Figure 6:
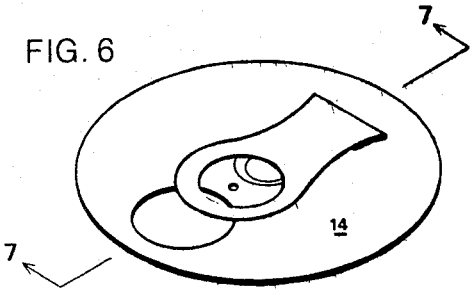
FIG. 6 is a perspective view of the novel easy opening top closure member assembly in its open position.
Figure 7:
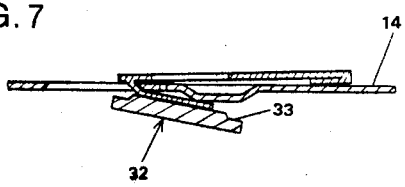
FIG. 7 is a cross sectional view taken along lines 7—7 of FIG. 6.

A disc member 32 is positioned beneath top member 14, and it is held in position by the adhesive layer 19. Disc member 32 has a flange 33 for providing a good seal for aperture 16 on its underside. An alternative structure for the disc member is illustrated in FIG. 8. Here disc member 35 has an annular flange 36, a raised central portion 37 and a recessed central portion 38.

What is claimed is:

1. An easy opening top closure member assembly for a container comprising:

a container top member having a cut-out portion defining an aperture of a predetermined configuration;

a strip member having a width and length greater than that of said aperture whereby said strip member completely covers the top of said aperture when it is positioned in its closed position;

a disc member having a width and length greater than that of said aperture whereby said disc member completely covers the bottom of said aperture when it is positioned in its closed position, the top surface of said disc member around its periphery being free of any adhesive where said disc member comes in contact with the bottom surface of said container top member that would prevent said disc member from being slid rearwardly beneath said container top member during the final stages of the operation of opening the top of said container; and means for securing the underside of said strip member to the top surface of said top member and also to the top surface of said disc member.

2. An easy opening top closure member assembly as recited in claim 1 wherein said means for securing the underside of said strip member to the top surface of said top member and also to the top surface of said disc member is a layer of pressure sensitive adhesive.

3. An easy opening top closure assembly as recited in claim 2 wherein said pressure sensitive adhesive is attached to the bottom surface of said strip member.

4. An easy opening top closure member assembly as recited in claim 1 wherein said strip member has an open-loop scored portion whose width and length are smaller than that of said aperture and said open-loop scored portion is positioned in contact with the top surface of said disc member.

5. An easy opening top closure assembly as recited in claim 4 wherein said open-loop scored portion has an interior hinge portion and two exterior hinge portions that are functionally activated when said strip member is lifted at its one end to open said easy opening top closure member assembly.

6. An easy opening top closure assembly as recited in claim 1 wherein said strip member is made from a flexible material.

7. An easy opening top closure assembly as recited in claim 1 wherein said strip member has a longitudinally extending tail portion that is used to open said top closure member assembly.

8. An easy opening top closure assembly as recited in claim 1 further comprising a pressure vent aperture in said top member positioned laterally from said aperture of a predetermined configuration, said pressure vent aperture being located in a position underlying said strip member in its closed position.

9. An easy opening top closure assembly as recited in claim 7 further comprising a concave dimple portion in the top surface of said top member, said dimple portion being located in a position underlying the tail portion of said strip member.

* * * * *